US006061979A

United States Patent [19]

Johannes

[11] Patent Number: 6,061,979

[45] Date of Patent: May 16, 2000

[54] INLINE SKATING SPORTS FLOOR

[76] Inventor: Nicholas J. Johannes, P.O. Box 180, 8042 Zurich, Switzerland

[21] Appl. No.: 09/163,366

[22] Filed: Sep. 30, 1998

Related U.S. Application Data

[60] Provisional application No. 60/060,424, Sep. 30, 1997.

[51] Int. Cl.[7] ..... A63C 19/04

[52] U.S. Cl. ..... 52/177; 52/180; 472/89; 472/90; 472/92

[58] Field of Search ..... 52/177, 180; 472/89, 472/90, 92

[56] References Cited

U.S. PATENT DOCUMENTS

| | | | |
|---|---|---|---|
| D. 260,107 | 8/1981 | Mittmann . | |
| 863,054 | 8/1907 | Dickerson . | |
| 1,948,826 | 2/1934 | Peterson . | |
| 2,174,716 | 10/1939 | Bethell . | |
| 2,924,455 | 2/1960 | Brunel . | |
| 3,438,312 | 4/1969 | Becker et al. . | |
| 3,497,211 | 2/1970 | Nagin . | |
| 3,699,926 | 10/1972 | Stockl | 52/177 X |
| 3,821,064 | 6/1974 | Cima . | |
| 3,922,409 | 11/1975 | Stark . | |
| 3,959,542 | 5/1976 | Livermore . | |
| 3,960,375 | 6/1976 | Bibi-Roubi et al. . | |
| 4,008,548 | 2/1977 | Leclerc . | |
| 4,030,729 | 6/1977 | Nathaniel . | |
| 4,226,064 | 10/1980 | Kraayenhof . | |
| 4,300,766 | 11/1981 | Haynes . | |
| 4,436,779 | 3/1984 | Menconi et al. . | |
| 4,577,448 | 3/1986 | Howorth . | |
| 4,584,221 | 4/1986 | Küng . | |
| 4,715,743 | 12/1987 | Schumanski | 52/177 X |
| 5,647,184 | 7/1997 | Davis | 52/177 X |
| 5,647,804 | 7/1997 | Homma et al. . | |
| 5,787,654 | 8/1998 | Drost | 52/177 |
| 5,826,382 | 10/1998 | Elsasser et al. | 52/177 X |
| 5,904,021 | 5/1999 | Fisher | 52/177 X |

*Primary Examiner*—Beth A. Aubrey
*Assistant Examiner*—Brian E. Glessner
*Attorney, Agent, or Firm*—Watson Cole Grindle Watson, P.L.L.C.

[57] ABSTRACT

A body has a substantially flat and very smooth support surface having a plurality of holes therein which intersect the support surface to form sharp edges around the holes. Connectors are provided on the sides of the body for connecting similar bodies to one another. A plurality of projections extend outwardly from the surface to enhance the glide properties of inline hockey pucks. The projections have a base dimension at the support surface in the range of about 0.5 mm to about 1.5 mm and extend outwardly from the surface a distance in the range of about 0.1 mm to about 0.6 mm. The projections are spaced from one another a distance in the range of about 3 mm to about 10 mm, and the density of projections per square centimeter of the support surface is in the range of about 1 to about 9.

14 Claims, 3 Drawing Sheets

10
24
16
26
30
22
D
A
11
E
B
C
18
14
H
F
G
20
12

10
26
24
20

INLINE SKATING SPORTS FLOOR

CROSS-REFERENCE TO RELATED APPLICATIONS

The present application claims the benefit of the priority date of provisional application Ser. No. 60/060,424, filed Sep. 30, 1997.

BACKGROUND OF THE INVENTION

The present invention relates to an inline skating sports floor which is especially adapted for use when playing inline roller hockey, but is also suitable for use as a general purpose sports surface with most indoor and outdoor ball sports and gymnastics.

Inline roller hockey is becoming a very popular sport around the world. In 1997, it was the fastest growing sport in the USA. Inline hockey is derived from ice hockey and is played where ice is not available. Inline roller skates are used when playing inline hockey, and the rules of the game are similar to those used in ice hockey. The big difference is that ice hockey is played on ice, while inline hockey is played on a hard dry surface.

Roller hockey players must be able to obtain a good grip between the rollers of their roller skates and the support surface of the floor on which they are playing in order to accelerate, turn while in extreme sideways leaning positions and maneuver during high speed skating. They must also be able to stop which requires a controlled side slip of the roller skates on the support surface. The balance between suitable grip and slip of the inline roller skates relative to the support surface is difficult to obtain. It is therefore an object of the invention to provide a floor which provides the desired characteristics of grip and slip of inline roller skates relative to the support surface.

The puck used in roller hockey is traditionally a plastic disk with protruding nylon studs on opposite sides thereof. This type of puck does not glide very well on prior art floors, and as a result, the game is slow, and passes of the puck from one player to another are short as compared to those made in ice hockey.

In order to provide a satisfactory floor, it is necessary to take into consideration the requirement for a variably controllable grip during cornering, acceleration and stopping as well good traction control of the skates at high speeds, while providing improved glide of the puck along the support surface of the floor.

SUMMARY OF THE INVENTION

The invention is illustrated as a plastic tile which can be connected to other plastic tiles to form a support surface. The structural features of the invention may also be incorporated into panels, mats, extruded bodies or sheets imprinted with a roller. Various materials may be used, but polypropylene is preferred.

Grip control during cornering and acceleration is obtained by providing a plurality of holes in the support surface. These holes may go part way through the body of the tile or all the way through, but in either case, sharp edges are formed where the holes intersect the support surface. These holes occupy less than about 25% of the total area of the support surface. At high skate loads, such as during acceleration, deceleration and tight cornering, the relatively soft skate wheels dig into these sharp edges and enhance the grip, enabling the skater to perform maneuvers similar to those performed when ice skating. To perform a stopping maneuver with side slip, the skater reduces the skate loads, balancing the amount of grip and slip. The holes in the support surface also prevents air pressure build-up underneath a puck so that the puck glides flat without a tendency to lift or roll.

The tiles of the invention are adapted to simply snap together when assembled to form a floor without the slightest trace of seams or gaps, the seamless support surface thus formed prevents the puck from bouncing as it moves over the surface.

In order to provide high speed traction, the wheels of the inline skates must find a good grip at high speeds. The invention surface is very smooth so as to prevent microscopic air bubbles from being trapped between the support surface and the polyurethane skate wheels. Trapped air can reduce the surface contact area and create high counterpressure. The very smooth support surface provides good side grip for controlled maneuvering at fast skating speeds. The support surface should be as smooth as possible, and this result may be obtained by using molds or other manufacturing tools which have polished surfaces so as to provide a support surface having the desired characteristic.

In order to obtain glide enhancement of the hockey puck used in roller hockey, the support surface is provided with a plurality of projections extending outwardly from the support surface. These projections limit the surface contact of the puck with the floor and enable the puck to glide faster and farther, thereby causing the puck speed to approach that obtained in ice hockey.

The projections can be of different shapes, but projections having the shape of a spherical segment or a pyramid have proved to be best for all speeds of the puck. The size, outward projecting distance, spacing and distribution of the projections are important features of the invention which have been determined by extensive research. The projections have a base dimension at the support surface in the range of about 0.5 mm to about 1.5 mm and extend outwardly from the surface a distance in the range of about 0.1 mm to about 0.6 mm. The projections are spaced from one another a distance in the range of about 3 mm to about 10 mm, and the density of projections per square centimeter of the support surface is in the range of about 1 to about 9.

DESCRIPTION OF THE PREFERRED EMBODIMENT

Figure 1:
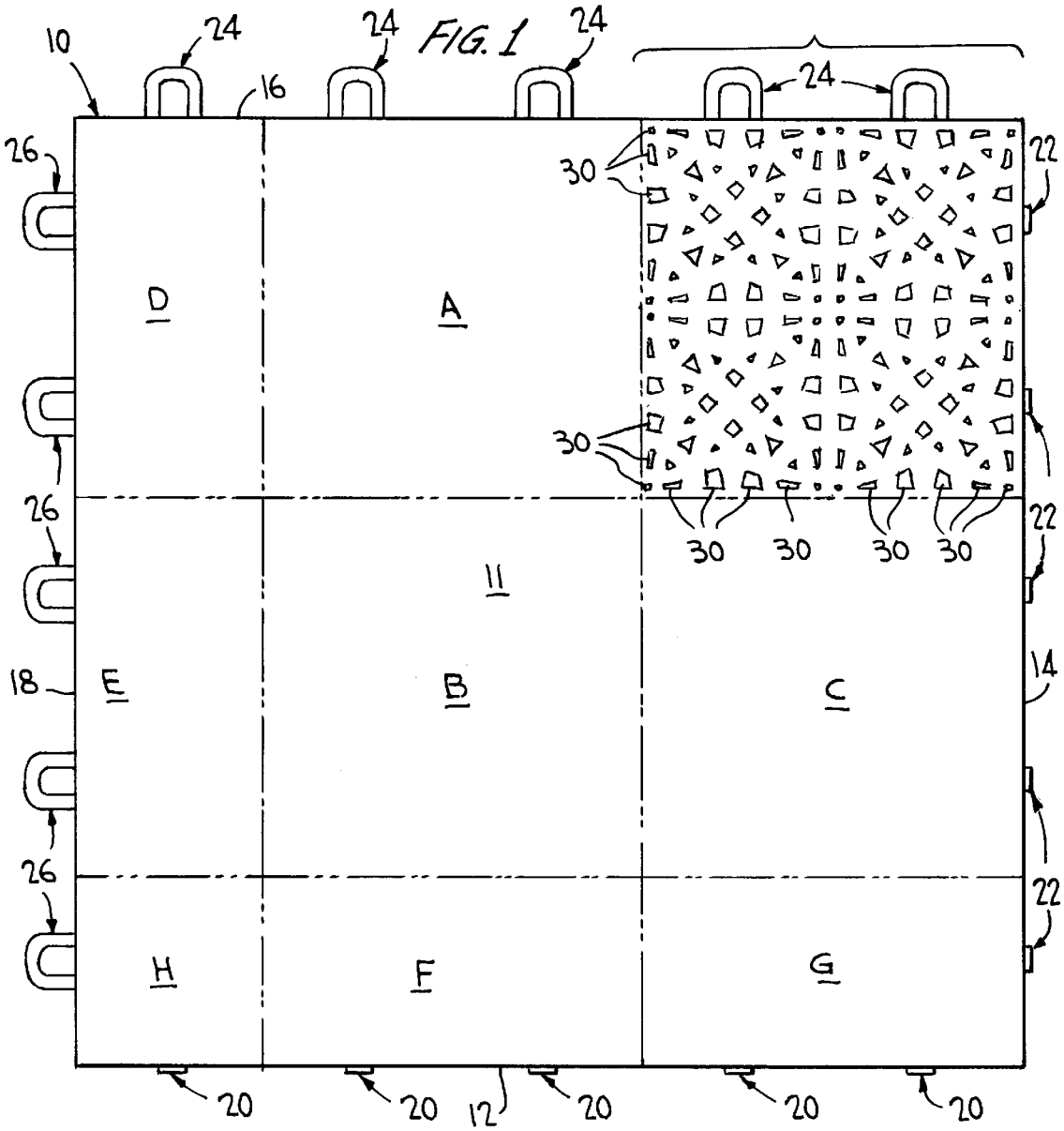
FIG. 1 is a top view of a plastic tile incorporating the present invention.

Referring to the drawings wherein like reference characters designate corresponding parts throughout the various views, a single tile body 10 is shown in FIG. 1 and includes an upward facing support surface 11 for supporting inline roller skates thereon. The body is molded as a one-piece construction and is formed of a suitable hard plastic such as reinforced polypropylene with ultra-violet (UV) and oxidation protection. In a typical example, the panel may measure 25×25 cm and has four sides 12, 14, 16 and 18. On sides 12 and 14, connectors 20 and 22 respectively are spaced therealong, while on sides 16 and 18, connectors 24 and 26 respectively are spaced therealong. Connectors 24 and 26 are formed as loops which are adapted to receive connectors 20 and 22 as explained hereinafter.

Figure 2:
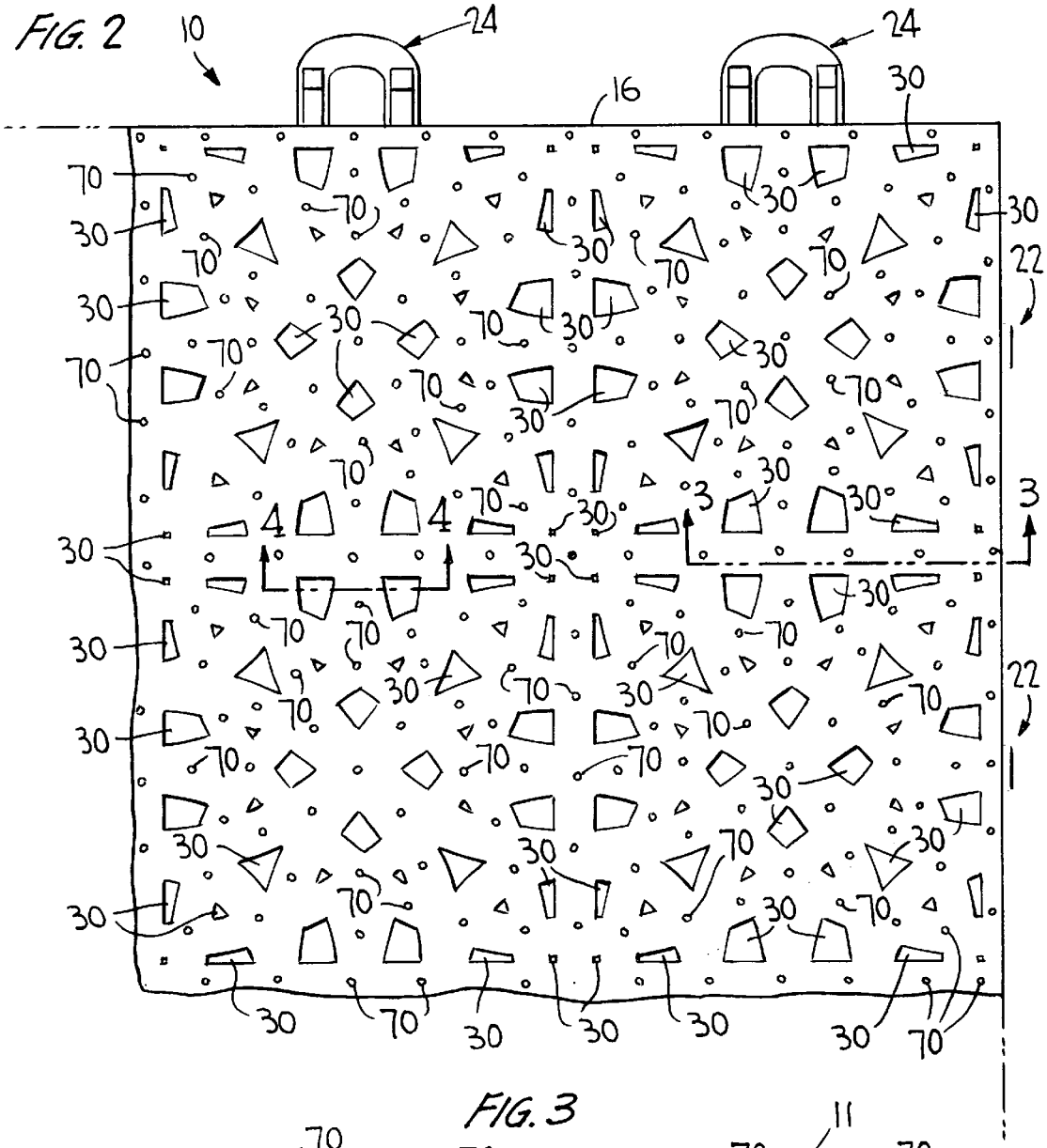
FIG. 2 is an enlarged view of part of the tile indicated by the bracket in FIG. 1.

As seen in the upper right-hand corner of the tile shown in FIG. 1 and as seen in FIG. 2, tile 10 has a plurality of holes 30 formed therein. The holes are shown as extending through the body, but the holes may only extend part way through the body if desired. Numerous holes are shown of different sizes and shapes to form a particular pattern resembling concentric rings of holes. However, the pattern may be varied and the size of the individual holes may be varied within certain parameters. The total area which the holes occupy should be less than about 25% of the total area of the support surface, and the holes have a dimension along the support surface in the range of about 1 mm to about 6 mm and are generally evenly distributed along the support surface.

The pattern shown in FIG. 1 may be repeated throughout the upper surface of the tile. As indicated by the imaginary phantom lines, the remaining upper surface of the tile may be divided into square and rectangular areas indicated by letters A, B, C, D, E, F, G and H. In squares A, B and C, the pattern in each of these squares is the same as that illustrated in FIG. 1. In rectangles D and E, the pattern is the same as the right half of the pattern illustrated. In rectangles F and G, the pattern is the same as the lower half of the pattern illustrated. In square H, the pattern is the same as the upper right quarter of the pattern illustrated. No particular pattern is required, and the holes may be placed in a random manner as long as they meet the parameters set forth above.

An important feature of the holes is that where they intersect the support surface, sharp edges are formed around the holes. This can clearly be seen in FIG. 4 wherein two holes 30 are formed through the tile body 10.

Figure 3:
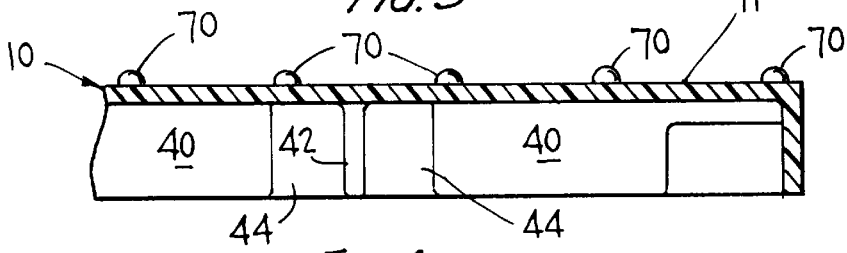
FIG. 3 is a sectional view taken along line 3—3 of FIG. 2.
Figure 4:
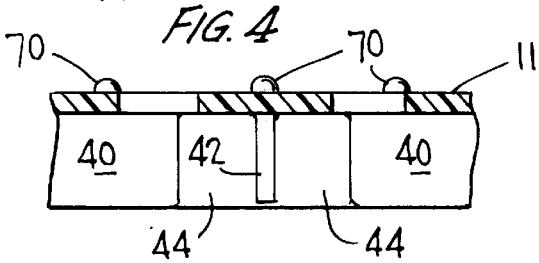
FIG. 4 is a sectional view taken along line 4—4 of FIG. 2.
Figure 5:
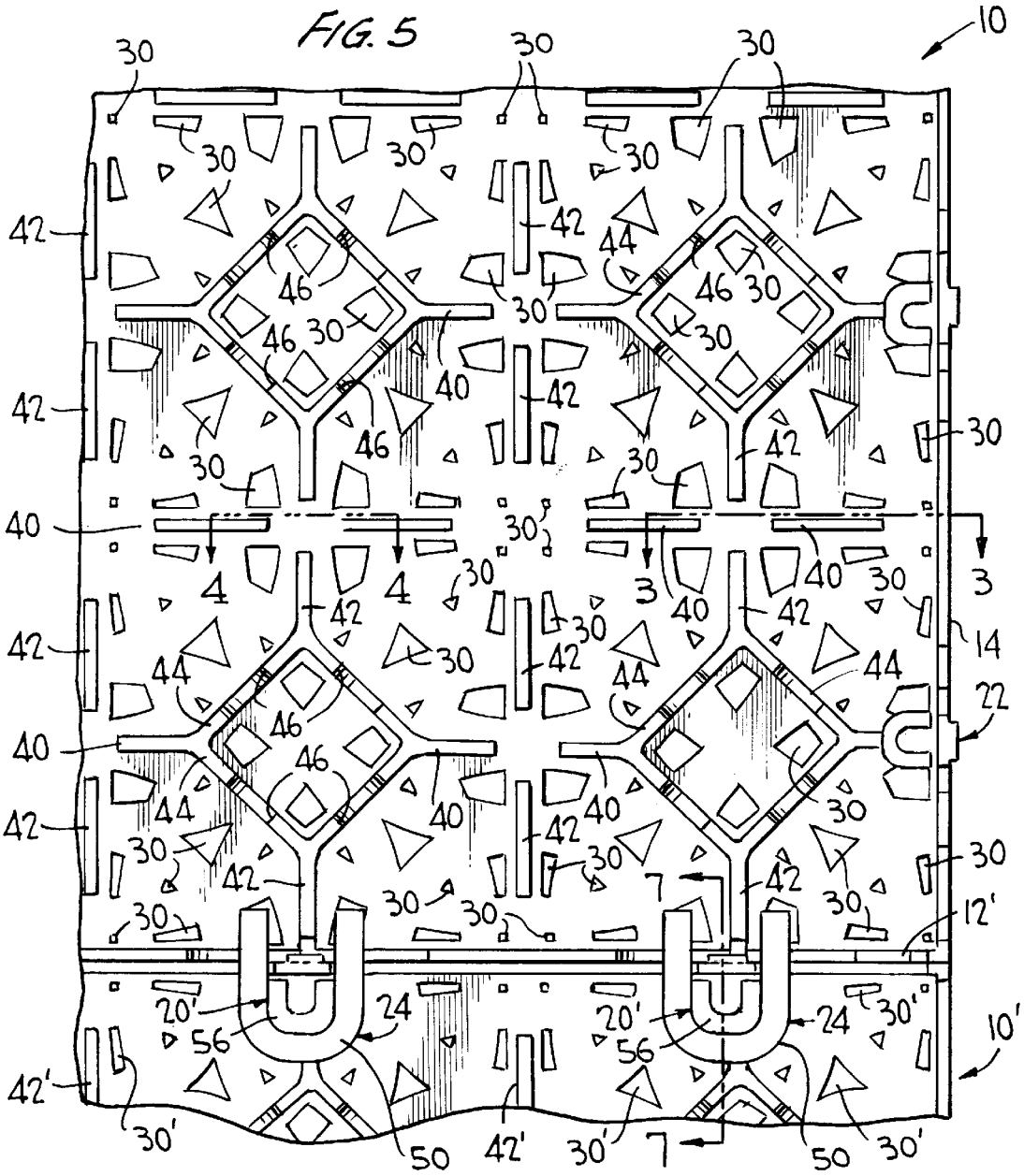
FIG. 5 is a bottom view showing portions of two tiles connected together.

Referring to FIGS. 3, 4 and 5, the underside of body 10 has a plurality of depending strengthening ribs 40, 42 and 44 depending therefrom. Ribs 40 are disposed parallel with sides 12 arid 16 of the body, while ribs 42 are disposed parallel with sides 14 and 18 of the body. Ribs 44 extend at 45 degree angles to the sides of the tile and extend between ends of ribs 40 and 42, some of ribs 44 being provided with circular cutouts 46 in the lower edges thereof.

Figure 6:
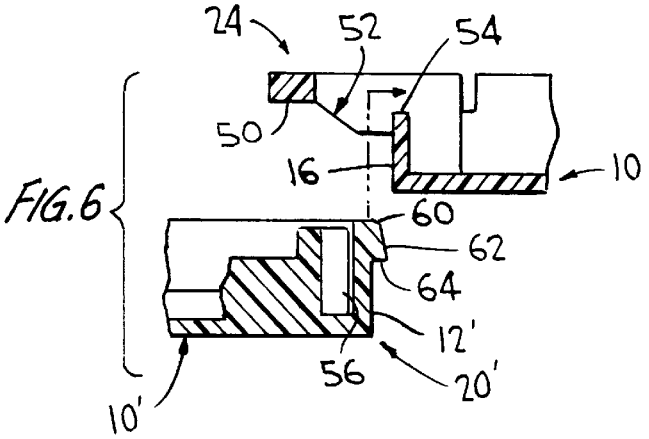
FIG. 6 is an exploded view showing cooperating connectors on two adjacent tiles in disconnected relationship.
Figure 7:
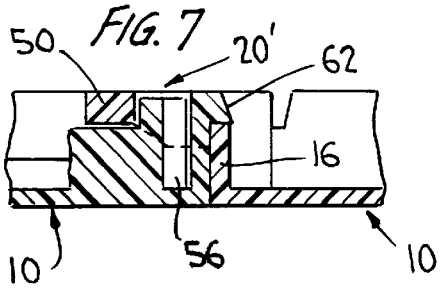
FIG. 7 is a view taken along line 7—7 of FIG. 5 showing the connectors of FIG. 6 in connected relationship.

Referring to FIG. 5, tile 10 is shown as connected to a similar tile 10' by loop connectors 24 on tile 10 and connectors 20' on tile 10', connectors 20' being identical to connectors 20 on tile 10. These connectors are of relatively conventional construction and are adapted to be interconnected to one another in such a manner that there is no interruption on the support surface where sides 16 and 12' of the two tiles abut one another. As seen in FIGS. 5 and 6, connector 24 includes a generally horseshoe portion 50 defining an opening 52 for receiving a portion of connector 20'. Side 16 includes a lower edge 54. Connector 20' includes a generally horseshoe portion 56 which fits snugly within horseshoe po lion 50. Side 12' of tile 10' includes a tab 60 having a sloping cam surface 62 to facilitate entry of the tab into the opening 52, and a shoulder 64 is formed on the tab. As seen in FIG. 7, when connector 20' is inserted into connector 24, tab 60 snaps into place with shoulder 64 in engagement with edge 54 so as to prevent the connectors from becoming accidentally disconnected. surface 11. These projections may have various shapes, but the preferred shapes are spherical segments such as hemispheres or pyramids each of which tapers to a smaller dimension in a direction away from the support surface. The projections are substantially evenly distributed on the support surface, although the spacing thereof may vary within certain limits.

The projections extend outwardly from the support surface a distance in the range of about 0.1 mm to about 0.6 mm and preferably about 0.2 mm. The projections have a base dimension at the support surface in the range of about 0.5 mm to about 1.5 mm, and preferably about 1 mm. The projections are spaced from one another a distance in the range of about 3 mm to about 10 mm and preferably in the range of about 3 mm to about 7 mm. The projections have a density per square centimeter of the support surface in the range of about 1 to about 9, and preferably in the range of about 3 to about 6. In the embodiment shown in the drawings, the projections have a base dimension at the support surface of about 1 mm and they extend outwardly away from the surface a distance of about 0.2 mm. The projections are spaced from one another a distance of about 4 mm to about 10 mm, and the projections have a density per square centimeter of the support surface of about 3 to 4.

Figure 1A:
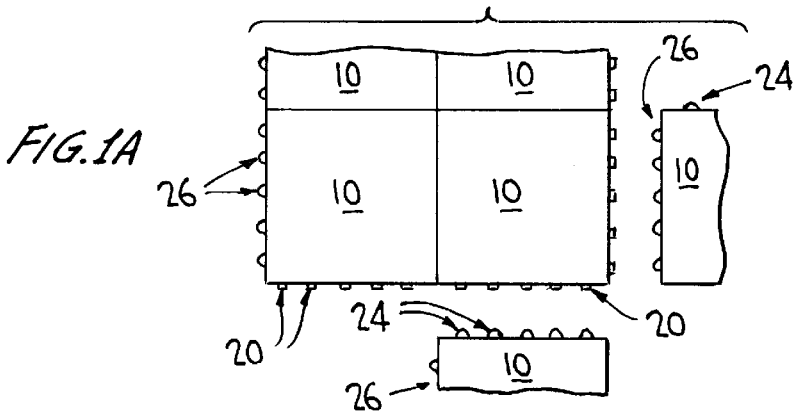
FIG. 1A is a schematic view illustrating the manner in which a plurality of tiles may be connected together to form a floor.

As seen in FIG. 1A, a plurality of identical tiles 10 can be connected together to form a finished floor. Four tiles are illustrated as already interconnected, while two more tiles are shown as positioned to be connected to one of the tiles already connected together It is apparent that numerous tiles can be interconnected in this manner to provide a floor of desired size.

The invention has been described with reference to a preferred embodiment. Obviously, various modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. An inline skating sports floor comprising, a body having a support surface for supporting inline skates thereon, said surface being substantially flat and very smooth, said surface having a plurality of holes formed therein and intersecting said surface to form sharp edges around said holes, said holes occupying less than about 25% of the total area of said surface, and a plurality of projections extending outwardly from said surface for enhancing the glide properties of inline hockey pucks, said projections being substantially evenly distributed on said surface, said projections extending outwardly from said surface a distance in the range of about 0.1 mm to about 0.6 mm, said projections having a density per square centimeter of the support surface in the range of about 1 to about 9.

2. A floor as defined in claim 1 wherein said holes have a dimension along said surface in the range of about 1 mm to about 6 mm.

3. A floor as defined in claim 1 wherein said holes extend only part way through said body.

4. A floor as defined in claim 1 wherein said holes extend all the way through said body.

5. A floor as defined in claim 1 wherein said holes are of different sizes and shapes.

6. A floor as defined in claim 1 wherein said projections extend outwardly from said surface a distance of about 0.2 mm.

7. A floor as defined in claim 1 wherein said projections have a base dimension at said surface in the range of about 0.5 mm to about 1.5 mm.

8. A floor as defined in claim 1 wherein said projections have a base dimension at said surface of about 1 mm.

9. A floor as defined in claim 1 wherein said projections are spaced from one another a distance in the range of about 3 mm to about 10 mm.

10. A floor as defined in claim 1 wherein said projections are spaced from one another a distance in the range of about 3 mm to about 7 mm.

11. A floor as defined in claim 1 wherein said projections have a density per square centimeter of the support surface in the range of about 3 to about 6.

12. A floor as defined in claim 1 wherein said body includes a plurality of side edges, and connector means disposed along said edges for connecting adjacent bodies to one another.

13. A floor as defined in claim 1 wherein said projections are generally hemispherical or pyramidal in configuration.

14. A floor as defined in claim 1 wherein said projections taper to a smaller dimension in a direction away from the support surface.

* * * * *